United States Patent [19]

Salem

[11] 4,164,735

[45] Aug. 14, 1979

[54] PIEZOELECTRIC AUDIBLE INDICATOR CIRCUIT

[75] Inventor: Robert J. Salem, Danbury, Conn.

[73] Assignee: General Electric Company, New York, N.Y.

[21] Appl. No.: 843,137

[22] Filed: Oct. 17, 1977

[51] Int. Cl.[2] ..... G08B 3/00

[52] U.S. Cl. ..... 340/384 E; 340/384 R

[58] Field of Search ..... 340/384 E, 384 R, 15; 331/116 R

[56] References Cited

U.S. PATENT DOCUMENTS 3,569,963 3/1971 Mallory ..... 340/384 E

*Primary Examiner*—Harold I. Pitts

*Attorney, Agent, or Firm*—Carlos Nieves; George R. Powers; Marvin A. Goldenberg

[57] ABSTRACT

An audible indicator circuit including a piezoelectric crystal and transistor device, that is of extremely simple and inexpensive construction and has its on-off operation selectively controlled in response to an automatic or manually applied control signal. The piezoelectric crystal is connected between the collector and emitter electrodes of the transistor, so that with an "on" control signal applied to the base electrode and a supply voltage of magnitude that exceeds the collector to emitter breakdown voltage coupled to the collector electrode, the circuit is caused to oscillate and thereby emit an audible signal.

5 Claims, 3 Drawing Figures

PIEZOELECTRIC AUDIBLE INDICATOR CIRCUIT

BACKGROUND OF THE INVENTION

There are currently many different forms of audible indicator or alarm circuits that employ piezoelectric crystals. These circuits are commonly used in numerous small and large electrical appliances, alarm systems of various types and for other applications in which the generation of an audible signal is required. Of the many different circuits, most include relatively complex oscillator configurations and/or piezoelectric crystal structures. There are not known to be any truly simple and low cost piezoelectric circuits of this type.

SUMMARY OF THE INVENTION

It is accordingly an object of the invention to provide an improved piezoelectric audible indicator circuit that is of extremely simple design with a minimum number of components and is extremely inexpensive to construct.

It is a further object of the invention to provide an improved audible indicator circuit as above described that employs a simple, inexpensive piezoelectric crystal element.

Another object of the invention is to provide an improved audible indicator circuit as above described that may be supplied by ordinary household voltage.

Yet another object of the invention is to provide an improved audible indicator circuit as above described whose on-off operation may be readily controlled.

These and other objects are accomplished in an audible indicator circuit including a transistor device of given collector to emitter breakdown voltage, and a simple two electrode piezoelectric crystal coupled between the transistor collector and emitter electrodes. A supply voltage having a magnitude that exceeds the transistor breakdown voltage is applied through a collector resistor across the parallel connection of the transistor and the piezoelectric crystal for causing oscillation of the circuit by virtue of the internal crystal capacitance being successively charged to the breakdown voltage and discharged through the transistor. This action results in oscillation of the circuit and the generation of an audible signal at a frequency determined by the capacitance of the crystal, the transistor parameters and the collector resistance. A bias control signal is selectively coupled to the base electrode of the transistor for controlling on-off operation of the circuit.

In accordance with a more specific aspect of the invention, a control signal generator is provided for applying the control signal to the base electrode for biasing the transistor into a normal conductive state during an "off" operation to thereby prevent the circuit from oscillating. In response to a given condition or at a prescribed time corresponding to an "on" operation, the control signal acts to bias the transistor so as to oppose normal conduction whereby conduction occurs solely in the breakdown mode due to application of the supply voltage, causing the circuit to oscillate and thereby emit an audible signal.

In accordance with another more specific aspect of the invention, the bias control signal is applied by employing a manual switch to connect the transistor base electrode to either the supply voltage for biasing the transistor into its normal conductive state or to a reference point for biasing the transistor into its normal non-conductive state.

BRIEF DESCRIPTION OF THE DRAWING

While the specification concludes with the claims which particularly point out and distinctly define that subject matter which is regarded as the invention, it is believed the invention will be more clearly understood when considering the following detailed description and the accompanying figures of the drawing in which:

DESCRIPTION OF THE PREFERRED EMBODIMENTS OF THE INVENTION

Figure 1:
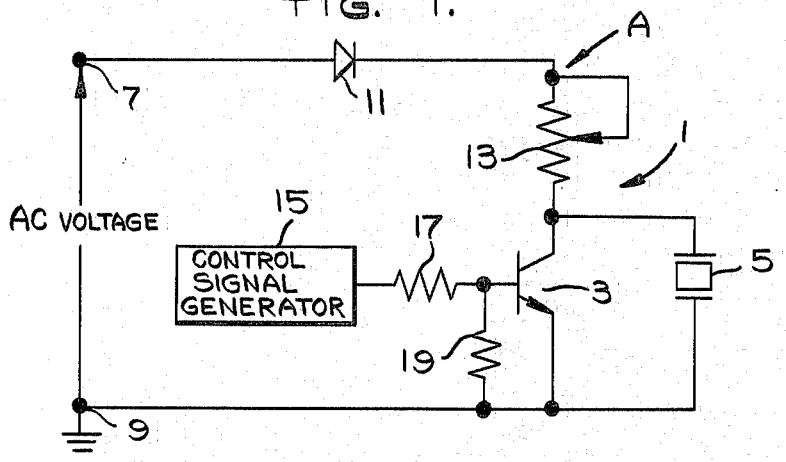
FIG. 1 is a schematic circuit diagram of one embodiment of a piezoelectric audible indicator circuit, in accordance with the invention.

With reference to FIG. 1, there is illustrated a piezoelectric audible indicator circuit 1, pursuant to a first embodiment of the invention, for generating an audible indication or alarm signal in response to an applied control signal. The circuit includes a transistor 3, which in the illustrated embodiment is of NPN type, and a two electrode piezoelectric crystal 5 connected between the collector and emitter electrodes of the transistor. The piezoelectric crystal 5 is a conventional two electrode crystal having metal plating on two opposing planar surfaces that are perpendicular to the direction of crystal polarization, which in response to an alternating electric field applied to said electrodes will expand and contract to displace air and emit an audible signal.

An AC voltage is applied to input terminals 7 and 9, of which terminal 9 is connected to a ground reference point. Terminal 7 is connected to the anode of a rectifying diode 11, the cathode of which is connected through a variable resistance 13 to the collector of transistor 3. The cathode of transistor 3 is connected to ground. The resistance 13 is illustrated in the form of a potentiometer for providing a ready adjustment of its value for varying the tone of the emitted audible signal, as will be further explained. For purposes of the invention, a fixed resistor can be employed. A control signal generator 15 generates a bias control signal that is applied through a current limiting resistor 17 to the base electrode of transistor 3 and across a bias resistor 19 connected from the base to ground for controlling the on-off operation of the circuit 1. Generator 15 may be of conventional design forming part of a timing circuit such as used in a toaster or other electrical appliance for signifying the end of a particular operation, or as used in a timing device for indicating a set elapsed period of time.

Transistor 3 is characterized by a given collector to emitter breakdown voltage, Vceo, which is a specified parameter, and by a collector to emitter sustaining voltage, Vsus. The latter voltage may not always be specified, but can be readily determined by measuring the breakdown voltage collector to emitter with the base open circuited. With a bias signal applied to the base of a nature to oppose conduction of the transistor and a supply voltage applied across the collector to emitter having a magnitude that exceeds Vceo, the transistor will conduct in its breakdown mode and sustain conduction for as long as the voltage across the collector to emitter exceeds Vsus.

In the operation of the audible indicator circuit 1, the piezoelectric crystal 5 is caused to oscillate under control of the bias signal applied to the base electrode of the transistor for generating an audible tone. Oscillation is achieved by operating the transistor in its breakdown mode in which the transistor exhibits a negative resistance characteristic. To achieve this mode of operation, the AC supply voltage must have an RMS value that exceeds the transistor collector to emitter breakdown voltage Vceo. In the embodiment under consideration, household supply voltage may be conveniently employed, with the diode 11 providing half wave rectification of the supply voltage. For purposes of the invention a DC supply voltage may be applied, providing it has a magnitude that exceeds Vceo.

During the "off" time when the audible signal is not sounded, a control signal from generator 15 is applied to transistor 3 so as to bias the transistor into its normal conductive state. This acts to apply a relatively constant voltage across the piezoelectric crystal that is substantially below Vceo and to thereby prevent the circuit from oscillating. During the "on" time, the control signal provides a bias that opposes normal conduction of the transistor, and conduction occurs in the breakdown mode under influence of the supply voltage applied to the collector electrode. As will be explained in detail, this results in the internal capacitance of the piezoelectric crystal 5 being sequentially charged and discharged during the positive going half cycles of the supply voltage, giving rise to the generation of an audible signal.

Figure 3:
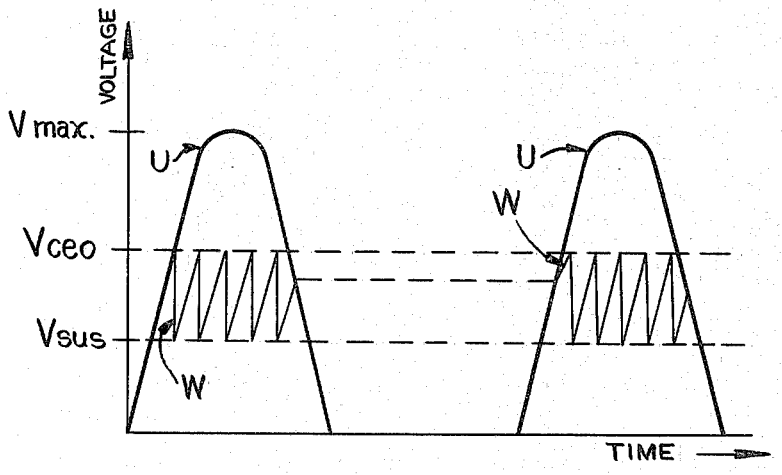
FIG. 3 is a graph useful in explaining the operation of the circuits of FIGS. 1 and 2.

Referring to the graph of FIG. 3 which illustrates the oscillatory operation, waveform U is the half sine wave rectified power supply voltage of frequency fs applied between point A and ground in FIG. 1. As this voltage rises from zero to Vmax, the internal capacitance of piezoelectric crystal 5 charges by current flowing through resistor 13. When the voltage across the piezoelectric crystal reaches the transistor breakdown voltage Vceo, the transistor conducts in its breakdown mode of conduction in which it exhibits a negative resistance characteristic, and rapidly discharges the piezoelectric capacitance. When the voltage across the crystal falls to a value just below the sustaining voltage of the transistor, Vsus, the transistor stops conducting. Upon the transistor ceasing to conduct, the piezoelectric capacitance once more charges and upon reaching the voltage Vceo, the transistor again conducts in its breakdown mode to discharge the piezoelectric capacitance. This cyclic process repeats for as long as the voltage between point A and ground exceeds the transistor breakdown voltage. The waveform W is thereby generated having a frequency fo that is a function of the resistance R of resistor 13, the piezoelectric crystal capacitance C, the negative resistance r of the transistor when in its breakdown mode, and the transistor voltages Vceo and Vsus. The audible signal will be generated as an amplitude modulated signal with fo as the carrier frequency accompanied by upper and lower side band components at fs.

In an exemplary operating embodiment of the circuit of FIG. 1 the following circuit components and parameters were employed:

| | |
|---|---|
| transistor 3 | GE type 2N2017<br>Vceo=60v, Vsus=30v |
| piezoelectric crystal 5 | Matsushita Type<br>EFB-593B21 |
| diode 11 | GE type 1N4003 |
| resistor 13 | 0–50K |
| resistor 17 | 14K |
| resistor 19 | 50K |
| supply voltage | 110v RMS |

Figure 2:
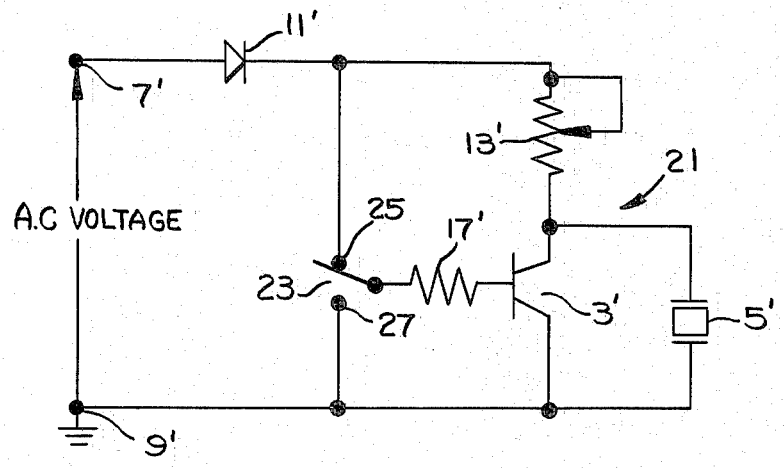
FIG. 2 is a schematic circuit diagram of a second embodiment of the inventive circuit.

In FIG. 2 is illustrated a further embodiment of a piezoelectric audible indicator circuit 21 wherein on-off operation of the circuit is under a manually switchable control. The circuit configuration and functioning is otherwise comparable to that of FIG. 1 and similar components as in FIG. 1 are assigned the same reference characters with an added prime notation.

Accordingly, the AC supply voltage is applied between terminals 7' and 9' and rectified by diode 11', the rectified voltage being applied to transistor 3' through potentiometer 13'. Piezoelectric crystal 5' is coupled across the transistor collector and emitter. In FIG. 2, the base is connected through resistor 17' and a single pole, double throw manual switch 23 to either the high voltage side of the circuit or to ground. With the switch movable arm contacting switch terminal 25, the cathode or output side of diode 11' is connected to the base for maintaining the transistor in its normal conductive state, in which case the audible indicator circuit is turned "off". The circuit is turned "on" through the switch movable arm contacting switch terminal 27 which grounds the base and prevents normal transistor conduction from occurring. This allows the piezoelectric crystal to develop a voltage across it that produces breakdown conduction of the transistor, and the circuit oscillates in the manner previously described.

What I claim as new and desire to secure by Letters Patent of the United States is:

1. A piezoelectric audible indicator circuit, comprising:

(a) a transistor device exhibiting a given collector to emitter breakdown voltage, Vceo, and a given collector to emitter sustaining voltage, Vsus, (b) a two electrode piezoelectric crystal exhibiting a given internal capacitance coupled between the collector and emitter electrodes of said transistor, (c) a collector resistance coupled to said collector electrode, (d) a supply voltage having a magnitude exceeding Vceo and supply means for coupling said supply voltage across the serial connection of said collector resistance and said collector and emitter electrodes, and (e) control means coupled to the base electrode of said transistor for controlling the on-off operation of the circuit by applying during the "off" time a control signal that biases the transistor into its normal conductive state and prevents the circuit from oscillating, and by applying during the "on" time a control signal that biases the transistor so as to oppose normal conduction whereby circuit oscillations result from the internal capacitance of said piezoelectric crystal being sequentially charged through said collector resistance to Vceo and discharged through the transistor conducting in its breakdown mode to Vsus, at which point the transistor once again ceases conduction, the process being cyclically repeated so as to cause said piezoelectric crystal to emit an audible signal.

2. A piezoelectric audible indicator circuit as in claim 1 in which said supply voltage is an alternating voltage having an RMS value that exceeds Vceo and said supply means includes a diode for providing rectification of said alternating voltage.

3. A piezoelectric audible indicator circuit as in claim 2 in which said collector resistance is a variable resistance for adjusting the frequency of said audible signal.

4. A piezoelectric audible indicator circuit as in claim 3 in which said control means comprises a signal generator circuit for automatically generating said control signal as a function of a given timing condition.

5. A piezoelectric audible indicator circuit as in claim 3 in which said control means includes a switch for selectively applying said control signal to said base electrode.

* * * * *